United States Patent [19]

Unrau

[11] 4,034,315

[45] July 5, 1977

[54] WAVEGUIDE DIRECTIONAL COUPLER

[75] Inventor: Udo Unrau, Lagesbuttel, Germany

[73] Assignee: Licentia Patent-Verwaltungs-G.m.b.H., Frankfurt am Main, Germany

[22] Filed: Feb. 27, 1976

[21] Appl. No.: 662,088

[30] Foreign Application Priority Data

Mar. 8, 1975 Germany ..... 2510212

[52] U.S. Cl. ..... 333/10; 333/98 R

[51] Int. Cl.[2] ..... H01P 5/18

[58] Field of Search ..... 333/10

[56] References Cited

UNITED STATES PATENTS

| | | | |
|---|---|---|---|
| 3,579,148 | 5/1971 | Blume | 333/10 |
| 3,741,625 | 6/1973 | Saleh | 333/10 X |

*Primary Examiner*—Paul L. Gensler

*Attorney, Agent, or Firm*—Spencer & Kaye

[57] ABSTRACT

A waveguide junction for joining together two pairs of rectangular waveguide arms, each pair being connected to present a corner connection, to form a directional coupler in which the four arms are arranged to define a cross, the junction being composed of an element constituting a partially radiation-permeable obstacle oriented diagonally to all of the waveguide arms and two waveguide sections each disposed between a respective side of the obstacle and a respective pair of waveguide arms and dimensioned so as to match the impedance at the surfaces of the obstacle to the values required at the corner connections in a manner to permit the coupler to operate in a frequency range which permits propagation of the desired waveguide mode while spurious modes excited in the coupler are evanescent.

10 Claims, 11 Drawing Figures

WAVEGUIDE DIRECTIONAL COUPLER

BACKGROUND OF THE INVENTION

The present invention relates to a waveguide junction composed of four rectangular waveguide branches, or arms, connected in the form of a cross, with a partially reflecting obstacle being disposed diagonally in the junction region to produce a directional coupler.

Waveguide connections employing multimode waveguides are known which employ directional couplers in which a suitably dimensioned dielectric slab is placed diagonally in a cruciform junction of the waveguides. This slab acts as a partially permeable mirror with respect to electromagnetic waves. A multimode directional coupler in rectangular waveguide technique has formerly been described by B. Wardrop: 'A quasi-optical directional coupler' in the Marconi Review, Vol. 35, No. 185, 2nd quarter 1972, pp. 159–169. In order to obtain a 3 dB coupling the permittivity of the dielectric slab has to be chosen between $3.4 \lesssim \epsilon_r \lesssim 4.0$.

FIG. 1 is a schematic representation of such a directional coupler. The four waveguide branches, or arms, 1, 2, 3 and 4 are usually combined into a precisely rectangular cross junction. However it is also possible to have them intersect at any desired angle. As can be seen in the sectional view of FIG. 1, a dielectric slab S is disposed in one diagonal of the junction and is mounted in a simple manner in that its ends usually protrude from the lateral sides of the waveguide junction.

In the operation of this coupler, a wave impinging in waveguide branch 1 is divided, in the ideal case, at dielectric slab S and distributed to the two waveguide branches 3 and 4 without being reflected back into waveguide branch 1 or diffracted into waveguide branch 2.

This ideal case is approached more closely, the more quasi-optically the waves propagate in the waveguides, i.e. the farther the operating frequency $f$ is removed from the cutoff frequency $f_c$ of the useful mode in the waveguides. Normally, however, waveguides are operated with the $H_{10}$ mode at frequencies only slightly above the limit frequency $f_c$; the conventional rectangular waveguide bands are dimensioned, for example, for frequencies of $1.25 f_c < f < 1.9 f_c$. For this monomode range, however, the known directional coupler shown in FIG. 1 is not well suited. This is so because the dielectric slab introduced in the diagonal is mismatched to a considerable degree at these frequencies, giving rise to substantial reflections back into waveguide branch 1 and diffractions into waveguide branch 2.

SUMMARY OF THE INVENTION

It is an object of the present invention, inter alia, to eliminate this drawback.

This and other objects of the invention are accomplished by inserting a waveguide section in front of and behind the partially reflecting obstacle to enable the coupler to operate in a frequency range in which the useful wave can propagate but not the spurious modes excited by the directional coupler, the waveguide sections being dimensioned so that the impedance at the surface of the obstacle is matched to the values required in the respective corner connections.

DESCRIPTION OF THE PREFERRED EMBODIMENTS

Figure 1:
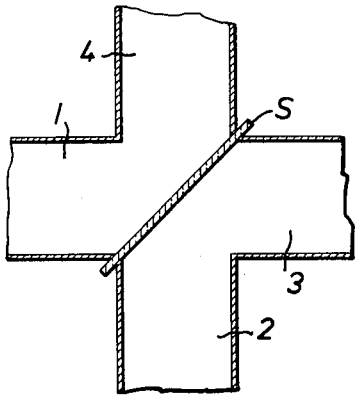
FIG.1 PRIOR ART
FIG. 1 is a simplified, cross-sectional view of a directional coupler according to the prior art, and has already been described in detail.
Figure 2:
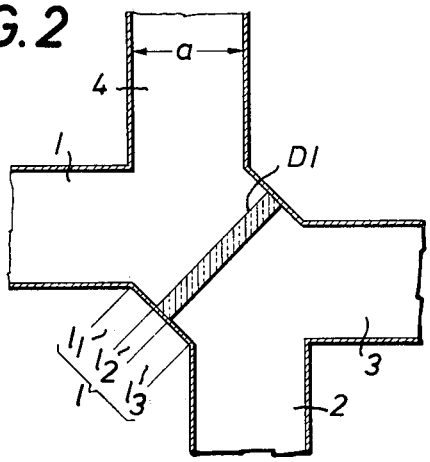
FIG. 2 is a view similar to that of FIG. 1 showing one preferred embodiment of the invention.

FIG. 2 shows a cross section through a waveguide junction according to the invention formed between four crosswise connected rectangular waveguides 1, 2, 3 and 4. Between the two corner connections of the feeder waveguides 1 and 4 and 2 and 3, respectively, there is inserted a suitably dimensioned waveguide of length 1. In the illustrated embodiment, a partially radiation permeable plate D1 is introduced in the diagonal defined by the additional waveguide so that a section of the additional waveguide is disposed at each side of the plate. Preferably plate D1 is formed by a slab of a suitably dimensioned dielectric material.

Thus, in the simplest case the intermediate piece of the waveguide junction includes three portions having respective partial lengths $l_1$, $l_2$ and $l_3$, the portions with the partial lengths $l_1$ and $l_3$ being empty and the central portion of length $l_2$ being filled with a dielectric material D1.

The waveguide sections with the lengths $l_1$ and $l_3$ here act as line transformers which transform the impedance at the surface of obstacle D1 to the value required at the respective corner connection. In the illustrated embodiment dimensions are given for a rectangular waveguide junction which branches symmetrically in the H plane. The dimension $a$ shown for the upper waveguide branch 4 in FIG. 2 is assumed to be that of the side which determines the limit frequency of the $H_{10}$-mode, usually the broad side.

If $$l_1 = l_3 = 0.2a,$$

$$l_2 = 0.26a,$$

and the relative dielectric constant of the inserted slab D1 is selected to be $$\epsilon_r = 1.8,$$

a 3 dB coupler is obtained. This permittivity is considerably lower than in the quasioptical coupler.

Figure 3:
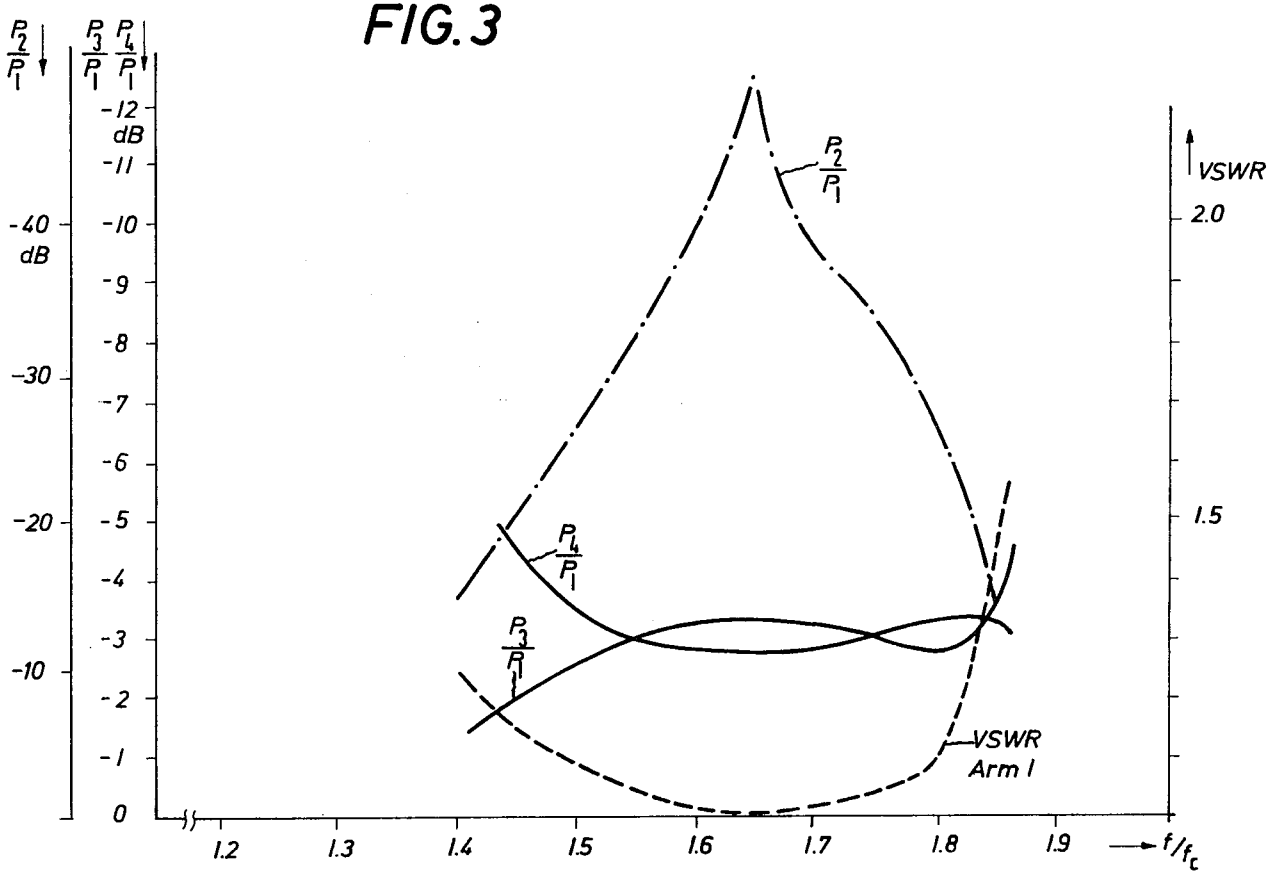
FIG. 3 is a graph showing the characteristics of the form of construction of the embodiment of FIG. 2.

The characteristics of this directional coupler are shown in FIG. 3. The scales for the power ratios $P_2/P_1$, $P_3/P_1$ and $P_4/P_1$, respectively, for the associated waveguide arms are shown on the left of the graph, while the input standing wave ratio, VSWR, values are shown on the right. It can be seen that in the frequency range of $1.51\, f/f_c$ to $1.81\, f/f_c$, i.e. over almost half the waveguide band, a coupling attenuation of 3 ± 0.35 dB, power transfer into the arm which is to be isolated of less than −25 dB, and an input standing wave ratio VSWR < 1.1 can be attained. By changing the length, $l_2$, and the dielectric constant of the inserted slab D1, the magnitude of the coupling and the frequency range for a small input standing wave ratio VSWR can be shifted.

Figure 4:
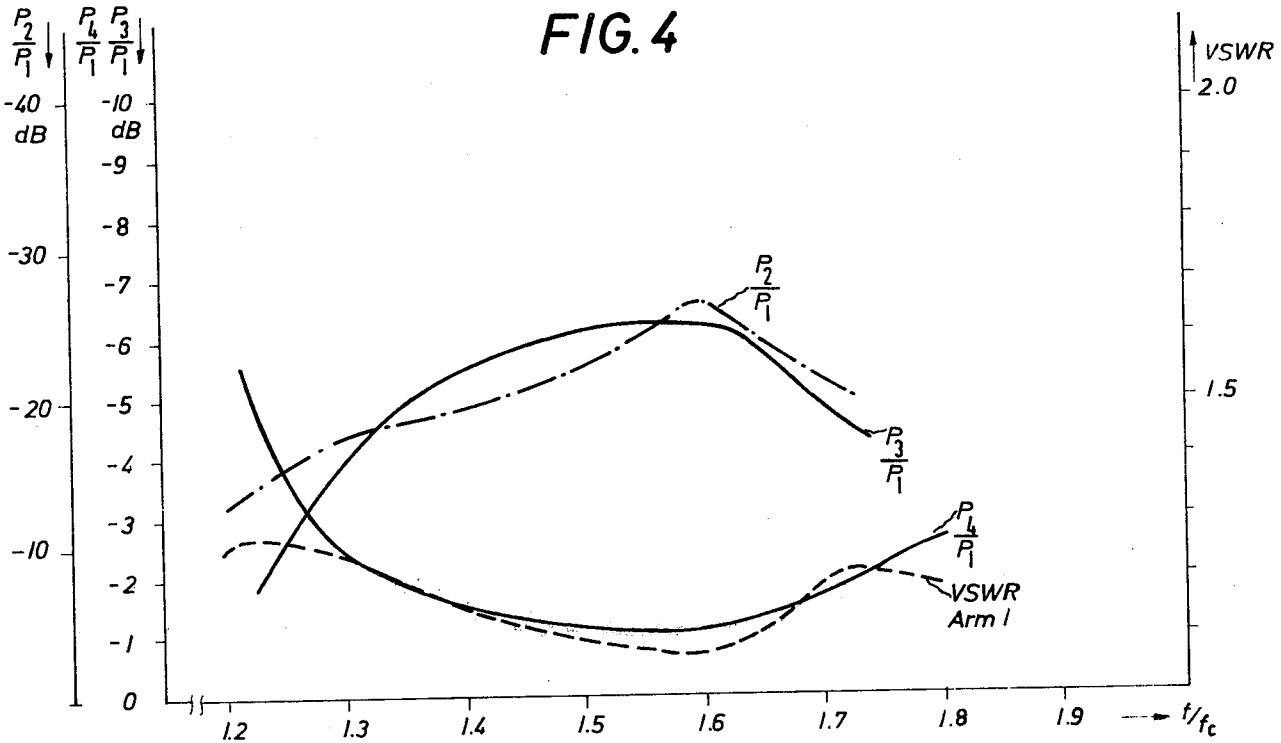
FIG. 4 is a graph showing the characteristics of a second form of construction of the embodiment of FIG. 2.

The dimensions for a 6 dB directional coupler, constituting a further embodiment, are:

$$l_1 = l_3 = 0.23a,$$

$$l_2 = 0.2a,$$

$$\epsilon_r = 3.0.$$

such an embodiment produces the curves shown in FIG. 4.

The partially radiation-permeable obstacle which, according to the embodiment of FIG. 2, is a dielectric slab D1, may also be produced in a different way or may consist of a plurality of partial permeable obstacles. It is possible, for example, to use perforated apertures known from the waveguide connection art, grids or slabs with an effective permeability of $\mu_r \neq 1$ for this purpose. In this case in all embodiments the permittivity $\epsilon_r$ of pure dielectrics has to be replaced by the product $\mu_r \epsilon_r$. On the other hand, the transformation lengths $l_1$ and $l_3$ need not be air-filled as in the embodiments of FIG. 2. These waveguide sections may also be made of one or a plurality of slabs of a material in which the product of the relative permeability constant and the dielectric constant is unequal to 1 ($\mu_r \cdot \epsilon_r \neq 1$).

Just as with quasi-optical directional couplers or with single-mode waveguide corner connections, the intersection of the feeder waveguides may also be effected at an angle other than 90°. In that case the lengths of the individual waveguide sections must be changed in a suitable manner from the value for a right-angle intersection to produce matching for the modified impedances.

In contradistinction to the perforated couplers for high coupling factors, which are relatively long for low frequency waveguide bands, the proposed directional coupler is very compact and, due to its crossed configuration, is well suited for handling high energy levels.

Figure 5:
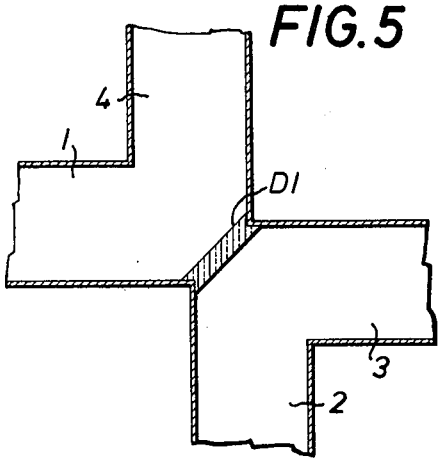
FIGS. 5, 6 and 7 are views similar to that of FIG. 2 of three further embodiments of the invention.

The center piece of the waveguide junction need not necessarily be a section of rectangular shape. The center piece of the directional coupler may also be designed, for example, as shown in FIG. 5, as an extension of the feeder waveguide walls so as to better hold the dielectric material and to facilitate manufacture. In this case waveguide branches 2 and 4 and 1 and 3, respectively, are laterally offset while remaining parallel to one another with respect to their longitudinal axis. D1 again is the dielectric slab.

Figure 6:
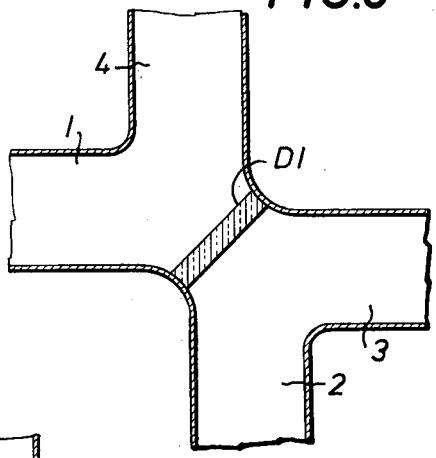

If the waveguide branch connection is to be used for particularly high field intensities, it is advantageous to round off some or all of the corners, to form the embodiment shown schematically in FIG. 6.

Since the optimum properties of a directional coupler appear only within a limited frequency band, suitable waveguide transition pieces may be connected ahead of the directional coupler to enable it to operate in another part of the frequency band. With the use of conventional waveguides in the circuit outside of the directional coupler, a dimension is thus selected for the feeder waveguides of the directional coupler itself which permits operation in the desired frequency range. In this case the waveguide transition pieces are usually arranged at such a distance from the directional coupler that higher order modes excited by the directional coupler, which however are unable to propagate in its feeder waveguides, have been sufficiently attenuated.

It is further possible, as an extension of the present invention, to fill the dielectric slab, and possibly also the waveguide sections, with layered dielectric materials so as to provide matching. However, in such multiple-layer dielectric materials each individual layer contributes to the total reflection as well as to matching, and separation according to partially reflecting obstacles and matching pieces will not always be unequivocal. The characteristic feature is here again, however, that the totality of all layers must effect partial reflection as well as matching.

Figure 7:
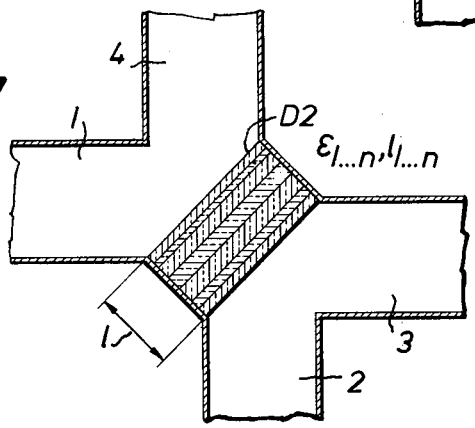

Such a layered arrangement is shown schematically in FIG. 7 in which the dielectric slab D2 and the transformation pieces fill the total length 1 of the waveguide junction and each transition piece is composed of a plurality of dielectric layers, while the partial lengths $l_1 \ldots l_n$ and their dielectric constants, $\epsilon_1 \ldots \epsilon_n$ are suitably selected.

A practical embodiment of a directional coupler having a plurality of dielectric materials was given dimensions such that a coupling attenuation of 3 dB ± 0.14 dB resulted. This directional coupler was assembled from standard R 100 rectangular waveguides having a wide side $a = 22.86$ mm. The waveguide material was copper. Over the matching lengths $l_1 = l_3 = 4.3$ mm the waveguide was filled with a foamed material having a dielectric constant $\epsilon_r = 1.2$, being a foamed material sold under the trade name of ECCOFOAM-PS. Section $l_2$ was occupied by a dielectric slab D2 5.3 mm long and composed of polytetrafluoroethylene, sold under the trade name Teflon.

Figure 8:
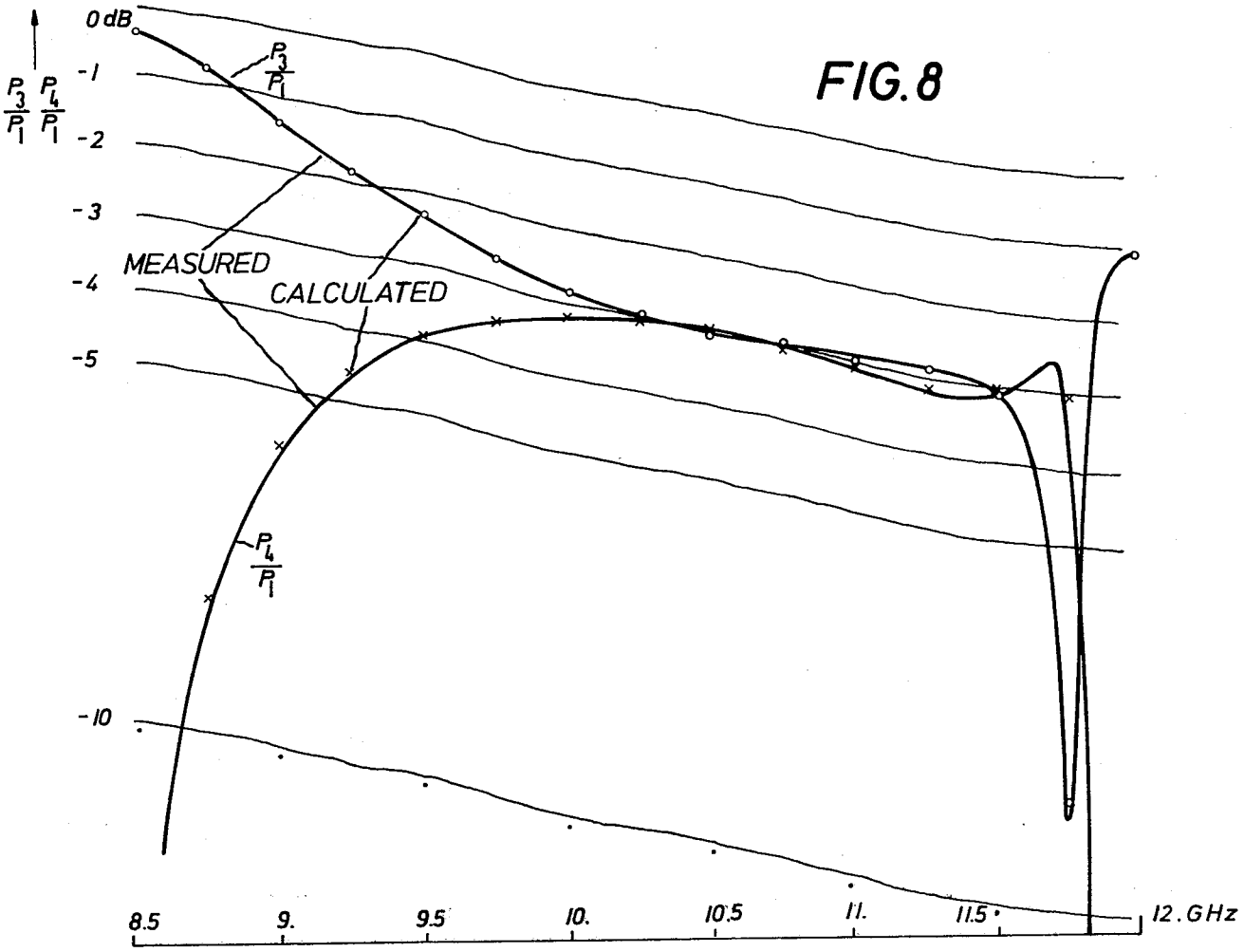
FIGS. 8, 9, 10 and 11 are graphs showing various characteristics of specific forms of construction of embodiments of the invention.
Figure 9:
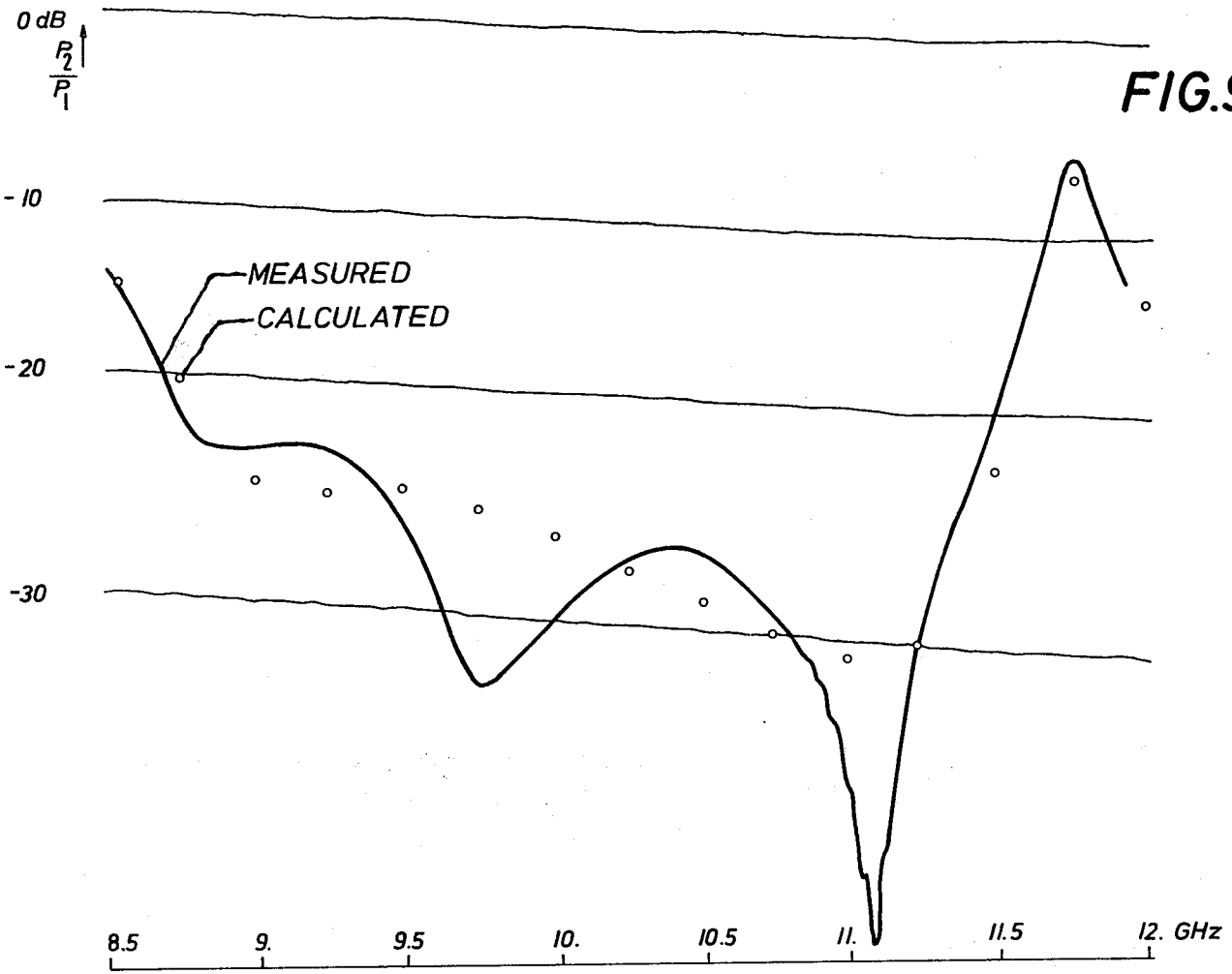

The measured curves for coupling attenuations $P_3/P_1$ and $P_4/P_1$ of this embodiment are shown in FIG. 8 and demonstrate very good coincidence with the theoretical values represented by the marked points, obtained on the basis of a calculation for the frequency range between 8.5 and 12 GHz under consideration. For the output $P_2/P_1$ however, shown in FIG. 9, in the isolated waveguide branch 2, the higher attenuation values show only general coincidence with the theoretically determined values. This is so because of the load resistances which in the first laboratory experiment had not as yet been matched over a broad band.

Figure 10:
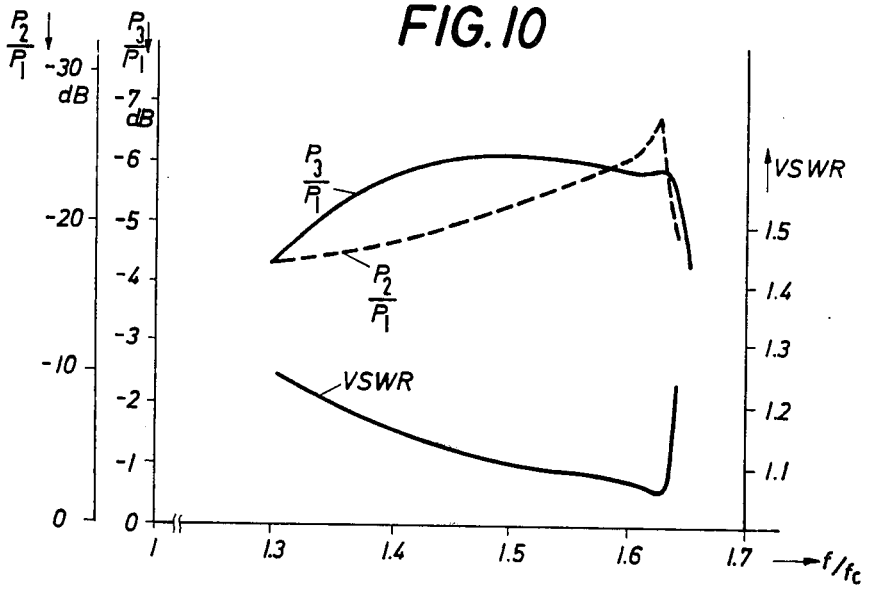

As already mentioned with reference to FIG. 7, various materials can be used for the dielectric disc, the specific material having an influence, over wide ranges, only on the dimensions selected. Thus, FIG. 10 shows calculated curves for a 6 dB directional coupler having the structure of FIG. 2 and in which the following were selected:

$$l_1 = l_3 = 0.24a,$$

$$l_2 = 0.22a,$$

$$\epsilon_r = 2.85.$$

Figure 11:
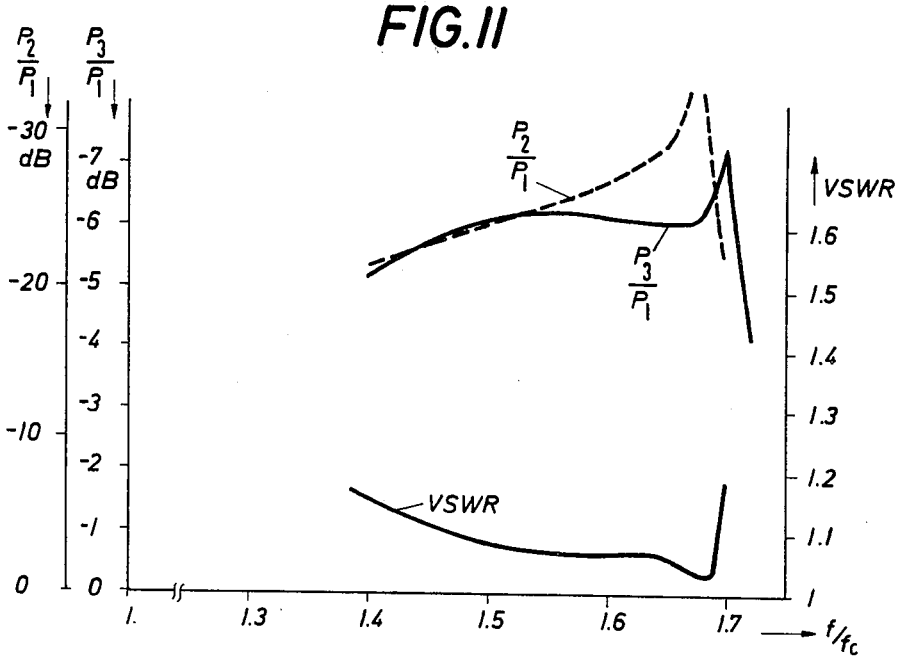

As a comparison, FIG. 11 shows calculated curves for a 6 dB directional coupler, also having the structure shown in FIG. 2, which had the following dimensions:

$$l_1 = l_3 = 0.3a,$$

$l_z = 0.11a,$ $\epsilon_r = 3.8.$

It is known that in rectangular waveguide connections the corners can be matched by setting back the mirror. This applies to connection in the H plane as well as to connections in the E plane. The waveguide junction, according to the present invention, can therefore be designed as a branch connection in the H plane as well as in the E plane. If the junction is made in the E plane, it will be less sensitive to manufacturing tolerances.

If the spurious modes generated in such a directional coupler are examined, it can be found that with a branch in the H plane, only $H_{mo}$ waves ($m = 1, 2, 3 \ldots$) of an $H_{10}$ useful wave are excited and with a branch in the E plane in the same case only $E_{1n}$ and $H_{1n}$ waves ($n = 1, 2, 3 \ldots$) are excited. Sometimes it might be desirable, for example in order to obtain low losses, to increase the cross-sectional dimensions of the feeder waveguides in such a way that none of the spurious modes excited in the directional coupler will be able to propagate therein but that, on the other hand, the $H_{10}$ wave will no longer be the only wave that can propagate. Thus it is possible, for example, to use rectangular waveguides with any desired dimensions for the waveguide height for junctions in the H plane without a change taking place in the efficiency or design of the directional coupler. Such a directional coupler is constructed of principally multimode waveguides, but operates, with respect to the useful wave and the spurious modes excited thereby, only in a monomode range.

It will be understood that the above description of the present invention is susceptible to various modifications changes and adaptations, and the same are intended to be comprehended within the meaning and range of equivalents of the appended claims.

What is claimed is:

1. In a waveguide junction composed of two pairs of rectangular waveguide branches arranged in the manner of the arms of a cross with at least one partially radiation-reflecting obstacle disposed in the junction diagonally of the arms to produce a directional coupler, the improvement wherein said junction comprises two waveguide sections each disposed at a respective side of said obstacle and interposed between said obstacle and a respective pair of waveguide branches, said waveguide sections constituting means for matching the impedance at the surface of the obstacle to the values required at the regions of connection between each pair of branches to permit the coupler to operate in a frequency range in which the useful waveguide mode can propagate while spurious modes excited in the coupler are evanescent.

2. Arrangement as defined in claim 1 wherein the directional coupler is arranged to operate in the single-mode range of the waveguide branches.

3. Arrangement as defined in claim 1 wherein said obstacle comprises a slab of a material for which the product of its relative permeability constant and its relative dielectric constant is unequal to 1.

4. Arrangement as defined in claim 1 wherein said obstacle comprises a plurality of individual slabs which are stacked in a layer transversely to the direction of propagation of waves in said junction.

5. Arrangement as defined in claim 1 further comprising a body of material at least partially filling said waveguide sections, with the product of the relative permeability constant and the relative dielectric constant of the material of said body being unequal to 1.

6. Arrangement as defined in claim 1 wherein a portion of said junction is defined by a rounded connection between the side walls to adjacent waveguide branches.

7. Arrangement as defined in claim 6 wherein said waveguide sections are defined by extensions of walls of said waveguide branches.

8. Arrangement as defined in claim 1 wherein said waveguide sections are rectangular in shape and have identical parallel side wall dimensions.

9. Arrangement as defined in claim 1 wherein said junction constitutes an E plane connection between said waveguide branches.

10. Arrangement as defined in claim 5 wherein said body of material is composed of a layered stack of different materials.

* * * * *